US005211407A

United States Patent [19]

Glynn et al.

[11] Patent Number: 5,211,407

[45] Date of Patent: May 18, 1993

[54] COMPRESSOR ROTOR CROSS SHANK LEAK SEAL FOR AXIAL DOVETAILS

[75] Inventors: Christopher C. Glynn, Hamilton; Roger C. Walker, Middletown, both of Ohio

[73] Assignee: General Electric Company, Cincinnati, Ohio

[21] Appl. No.: 876,602

[22] Filed: Apr. 30, 1992

[51] Int. Cl.[5] ..... F16J 15/32; F01B 5/32

[52] U.S. Cl. ..... 277/192; 277/25; 277/53; 277/188 R; 416/220 R

[58] Field of Search ..... 277/25, 53, 56, 192, 277/188 R, 199; 416/218, 219 R, 220 R

[56] References Cited

U.S. PATENT DOCUMENTS

| | | | |
|---|---|---|---|
| 3,644,058 | 2/1972 | Barnabei et al. | 416/219 |
| 3,814,539 | 6/1974 | Klompas | 416/218 |
| 4,019,833 | 4/1977 | Gale | 416/218 |
| 4,171,930 | 10/1979 | Brisken et al. | 416/220 R |
| 4,247,257 | 1/1981 | Benoist et al. | 416/220 R |
| 4,304,523 | 12/1981 | Corsmeier et al. | 416/220 R |
| 4,349,318 | 9/1982 | Libertini et al. | 416/220 R |
| 4,730,983 | 3/1988 | Naudet et al. | 416/220 R |
| 4,767,276 | 8/1988 | Barnes et al. | 416/220 R |
| 4,854,821 | 8/1989 | Kernon et al. | 416/220 R |
| 5,052,893 | 10/1991 | Catte | 416/220 R |

FOREIGN PATENT DOCUMENTS

| | | | |
|---|---|---|---|
| 1291302 | 10/1972 | United Kingdom | 416/219 |

*Primary Examiner*—William A. Cuchlinski, Jr.
*Assistant Examiner*—D. DePumpo
*Attorney, Agent, or Firm*—Jerome C. Squillaro

[57] ABSTRACT

A seal assembly for use in a compressor stage of a turbine engine having a rotor disk which is attached to a plurality of rotor blades. Each rotor blade has an axially oriented dovetail attachment which connects to the rotor disk. Each rotor blade has an aftward side which is in contact with a high pressure region and a forward side which is in contact with a low pressure region. A plurality of seal segments form an annular ring located radially inward from the plurality of rotor blades. Each seal segment has an offset center of gravity which causes each seal segment to be securely attached to the rotor disk as centrifugal forces act upon each seal segment during rotation.

4 Claims, 5 Drawing Sheets

COMPRESSOR ROTOR CROSS SHANK LEAK SEAL FOR AXIAL DOVETAILS

BACKGROUND OF THE INVENTION

The present invention relates to seals for gas turbine engines and, more particularly, to an air leakage seal for the blade root region of a compressor rotor blade.

Gas turbine engines have been utilized to power a wide variety of vehicles and have found particular application in aircraft. The operation of a gas turbine engine can be summarized in a three step process in which air is compressed in a rotating compressor, heated in a combustion chamber, and expanded through a turbine. The power output of the turbine is utilized to drive the compressor and any mechanical load connected to the drive. Modern lightweight aircraft engines, in particular, have adopted the construction of an axial-flow compressor comprising a plurality of lightweight annular disk members carrying airfoils at the peripheries thereof. Some of the disk members are attached to an inner rotor and are therefore rotating (rotor) blade assemblies while other disk members depend from an outer casing and are therefore stationary (stator) blade or vane assemblies. The airfoils or blades act upon the fluid (air) entering the inlet of the compressor and raise its temperature and pressure preparatory to directing the air to a continuous flow combustion system. The air travels through a flowpath which traverses several stages of rotor blades and stator vanes.

As air is directed downstream across a compressor rotor blade, a rise in pressure occurs. This pressure differential between the downstream side of the rotor blade and its upstream side creates an opportunity for air to leak back upstream through any root attachment gaps. These gaps can be blade-to-blade, i.e., those gaps existing between rotor blades in a given stage, and/or blade-to-disk, i.e., those gaps existing between a blade and the rotor disk to which it is attached.

The sealing of such blade-to-blade and blade-to-disk gaps has proved to be a difficult problem to address. Some of these gaps have been sealed by an elastomer or rubber-like compound which is squeezed into the gaps for the purpose of blocking a leakage path. However, in high temperature environments, such rubber-like seals have a propensity to fail as a result of being exposed to temperatures which exceed the thermal limits of the seal.

Thus, a need is seen for a seal which will effectively reduce blade-to-blade and blade-to-disk leakage in a compressor of a gas turbine engine.

SUMMARY OF THE INVENTION

The above and other disadvantages of the prior art are overcome by a seal assembly for use in a compressor of a turbine engine which seal assembly attaches to a periphery of a compressor rotor disk adjacent an axial edge of the root portion of rotor blades attached to the rotor disk. The seal assembly includes a plurality of arcuate seal segments, each having an offset center of gravity. Each seal segment has a plurality of radially extending fingers or tabs which engage mating fingers on the rim of the disk posts on the rotor disk. The assembled seal segments form an annular ring extending between the platforms of the rotor blades and an axial extension of the rotor disk thus overlaying the root portions of the blades. Centrifugal forces created by seal rotation during engine operation acts upon the offset center of gravity of the seal segments to produce a twisting action of each segment which serves to urge the seal segment into sealing engagement at the rotor blade platform and rotor disk.

The seal assembly of the present invention blocks a blade-to-blade leakage path between adjacent blade root areas along the rotor disk and also blocks a blade-to-disk leakage path between the blade roots and the rotor disk.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

When referring to the drawings, it should be understood that like reference numerals designate identical or corresponding parts throughout the respective figures.

DETAILED DESCRIPTION OF THE INVENTION

Figure 1:
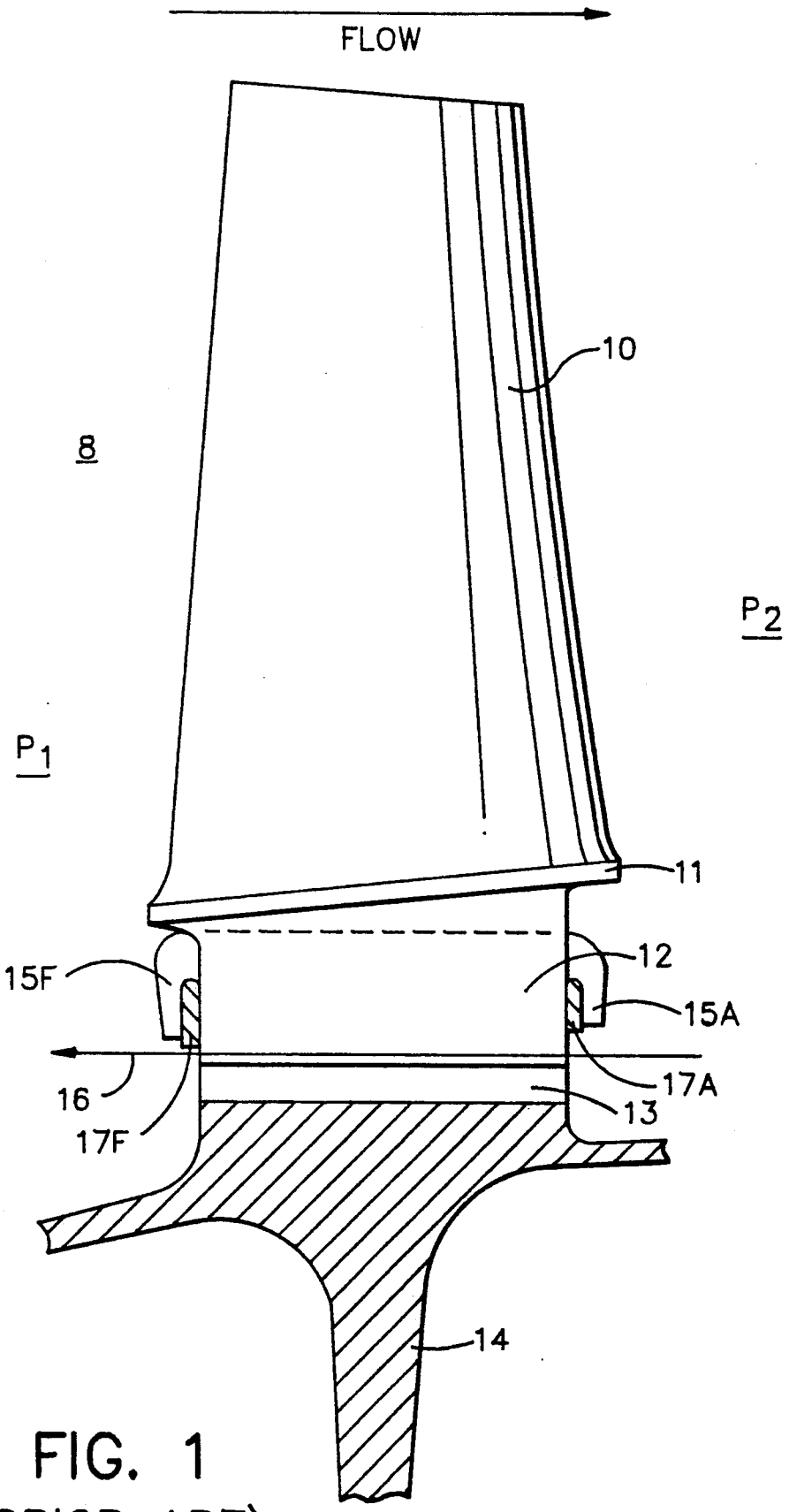
FIG. 1 (PRIOR ART)
FIG. 1 is schematic, circumferential view of a prior art compressor rotor blade and dovetail attachement.
Figure 2:
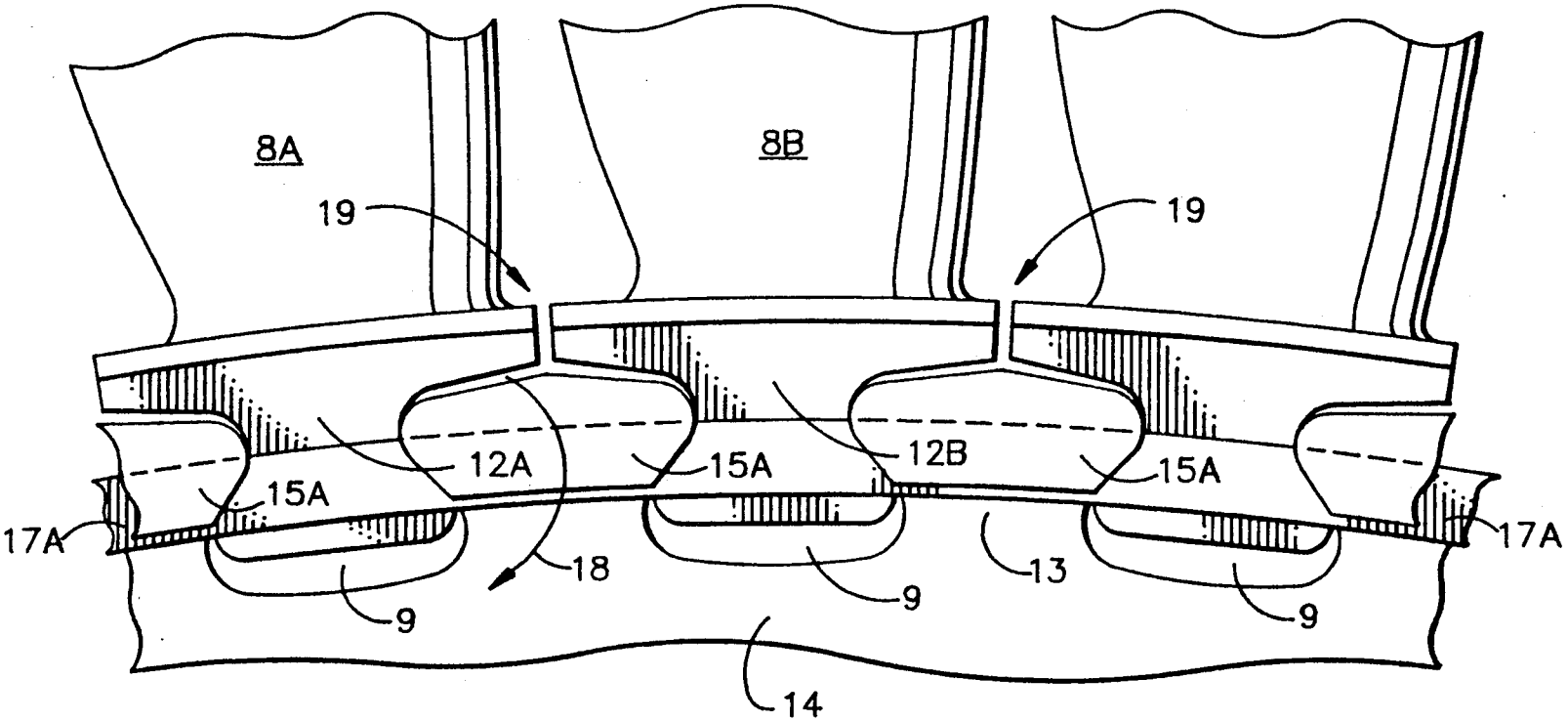
FIG. 2 (PRIOR ART)
FIG. 2 is a prior art schematic axial view of a dovetail attachment and rotor disk interface and serves to illustrate blade-to-blade and blade-to-disk leakage paths.

With reference to FIGS. 1 and 2, there is shown a prior art rotor blade to disk assembly in which a rotor blade 8 includes an airfoil 10, a platform 11 and a blade root 12. The root 12 is illustrated as a dovetail attachment but other forms of axially insertable roots may be used with the present invention. The blade root or dovetail 12 is inserted into mating slots 9 in the outer periphery of a rotor disk 14 for attaching the blade 8 to the disk 14. Disk posts 13 are defined between each of the disk slots 9. Tangs 15A and 15F are formed as part of the disk posts 13 and extend in a radially inward direction. The tangs 15 capture retaining rings 17A and 17F, which rings are used to prevent blade roots 12 from slipping axially out of the disk slots. An aft or downstream side of blade 8 faces high pressure region $P_2$ and a forward or upstream side of blade 8 faces low pressure region $P_1$. As a result of the pressure differential between $P_2$ and $P_1$, leakage airflow has a propensity to travel upstream from high pressure region $P_2$ to low pressure region $P_1$. FIG. 1 is a circumferential view of a rotor blade and disk assembly. Aligned with rotor blade 8 in a circumferential manner is a plurality of rotor blades (not shown) which comprise the rotor blades for a given stage of rotor blades in a turbine engine compressor. Arrow 16 indicates leakage airflow between adjacent rotor blades and between the blade roots and rotor disk 14.

In FIG. 2, an axial view demonstrates how leakage airflow is able to travel through blade-to-blade leakage path 19 as a result of gaps existing between rotor blades, particularly between platforms 11 of adjacent blades. The dovetail attachments 12A and 12B of rotor blades 8A and 8B are form-fitted in rotor disk 14. Gaps between the dovetail attachments 12A and 12B and the rotor disk 14 provide a blade-to-disk leakage path 18 which allows an additional amount of leakage air to flow from high pressure region $P_2$ to low pressure region $P_1$ (FIG. 1).

Figure 3:
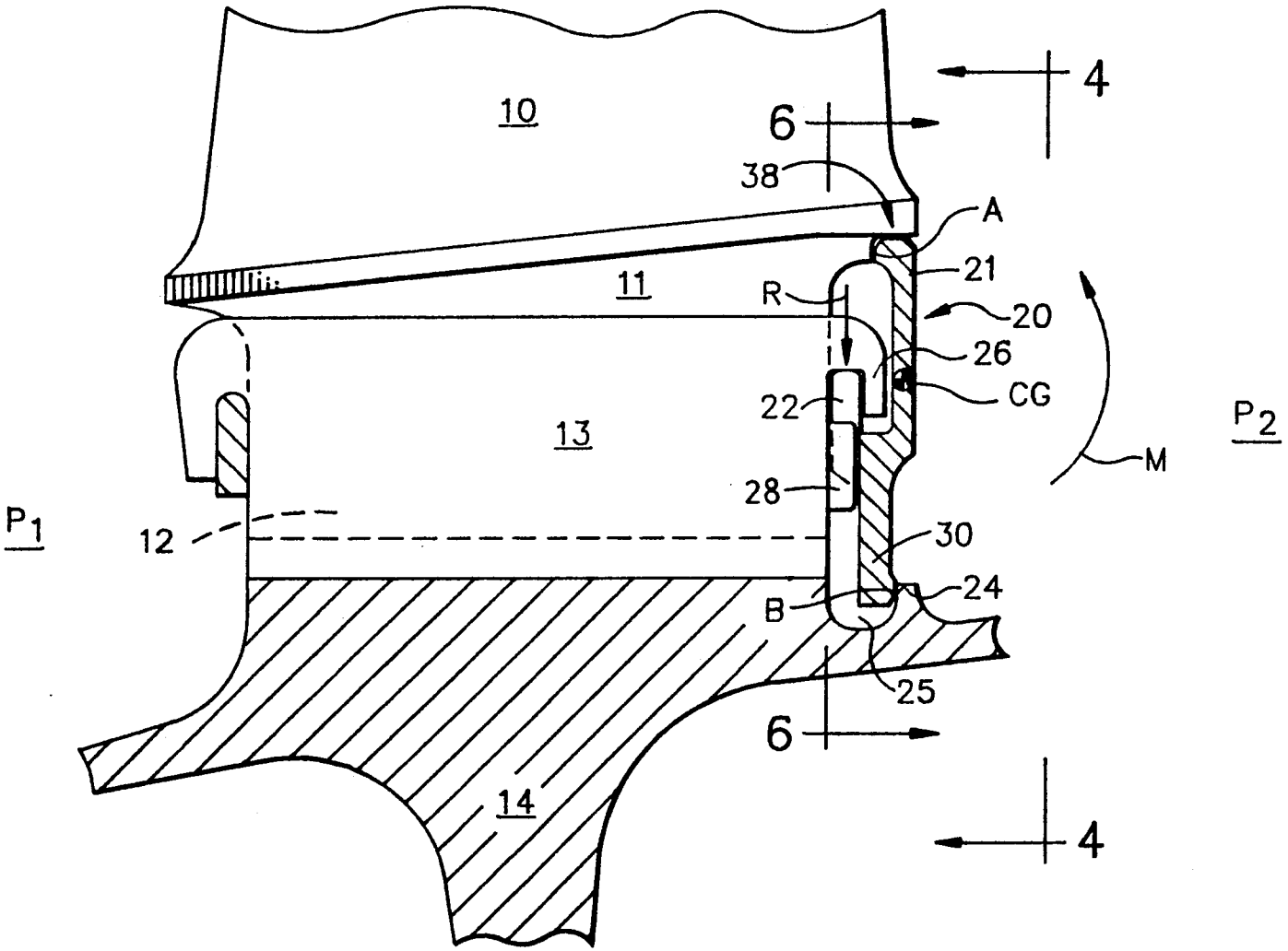
FIG. 3 is a circumferential schematic view of the seal assembly according to the present invention.
Figure 4:
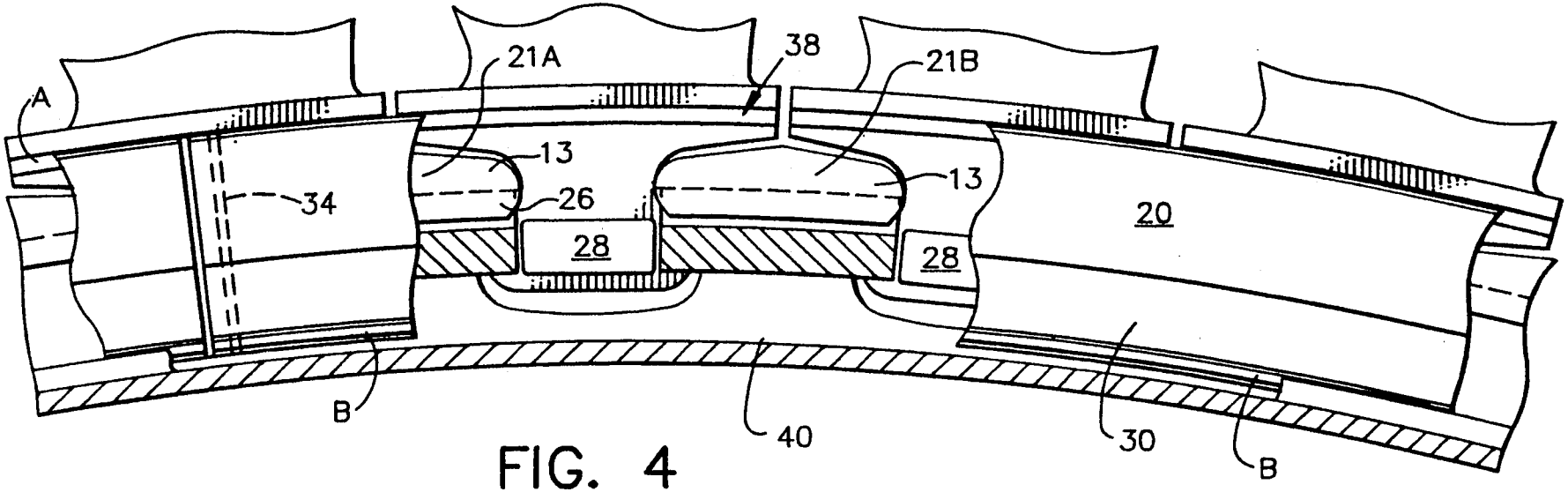
FIG. 4 is a schematic axial view looking from the aftward side forward and depicts the circumferentially connected seal segments of the present invention interfaced with the dovetail attachements of the rotor blades.
Figure 6:
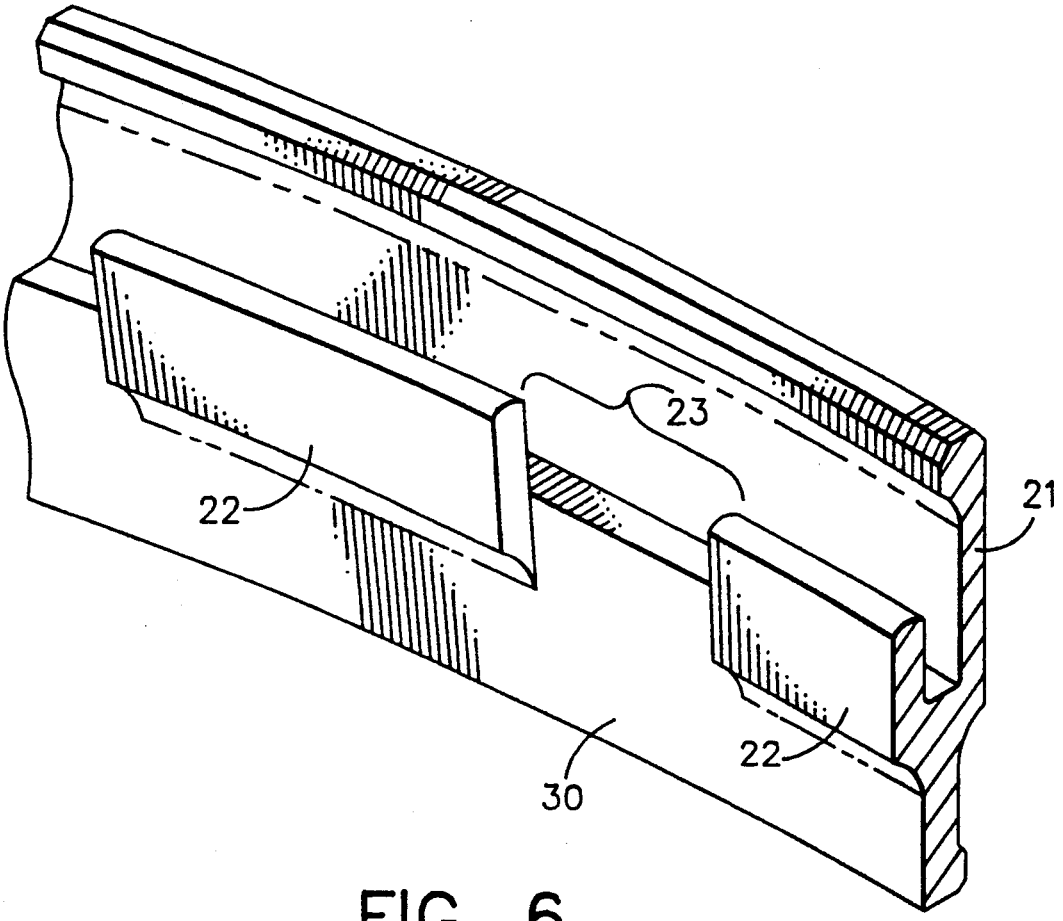
FIG. 6 is a partial perspective view of a seal segment of the present invention.

Turning now to the present invention and in particular to FIGS. 3 and 4, there is shown a retaining ring and seal segment 20 formed as an arcuate shaped member having an upper region 21 and a lower region 30. FIG. 3 is a cross-sectional view through a blade root and adjacent rotor disk portion showing the position of the seal segment 20 and its attachment in a sealing position adjacent a blade root portion. FIG. 4 is an axial view taken along the lines of 4—4 in FIG. 3. In the cross-sectional view of FIG. 3, the seal segment 20 has a fork-like configuration in which the lower region 30 is displaced axially from the upper region 21. A finger-like portion 22 extends radially outward from lower region 30 and generally parallel to upper region 21. A radially outer end of finger portion 22 is captured in the slot defined between disk post 13 and tang 15A. The fingers 22 actually comprise a plurality of circumferentially spaced fingers extending radially outward from the lower region 30. The fingers 22 are circumferentially spaced such that when the seal segment 20 is installed on the rotor disk, the spaces between the fingers are aligned with the rotor blade roots. The fingers 22 are less than the width of the blade root 12 at its narrowest dimension so that the fingers will fit between the tangs 15A during assembly. In particular, the seal assembly 20 can be installed by placing the radially inner end of lower region 30 into a groove 25 and then rotating the seal segment towards the rotor disk such that the fingers 22 are interdigitated with the tangs 15A. With all segments 20 in this position, the segment assembly can then be clocked or rotated until the fingers 22 are positioned behind the depending tangs 15A. The groove 25 is formed as a circumferential groove in the edge of the rotor disk and includes a circumferential flange 24 for capturing the radially inner end of the lower region 30. Referring briefly to FIG. 6, there is shown a perspective view taken along the lines 6—6 of FIG. 3 illustrating the configuration of seal assembly 20. Each of the rotor blade roots 13 have an arcuate extension 28 which extends axially aft between adjacent ones of the fingers 22. Interference between the fingers 22 and extensions 28 in a circumferential direction prevents seal 20 from clocking with respect to rotor disk 14 and thereby inhibits seal disengagement during engine operation. The extensions 28 also react against seal segment 30 in an axial direction preventing the rotor blades from slipping axially aft out of the rotor slots. In this respect, the seal 20 replaces the prior art retaining ring 17A.

When the seal segment is installed in the position shown in FIG. 3, there is preferably a contact point B at and along a radially inner edge of the seal segment 20 where the seal segment contacts the flange 24. A second contact point is located at A where the upper region 21 contacts a surface 26 formed on the underside of platform 11. In order to control the point of contact to better assure sealing engagement at the contact points A and B, the seal segment is formed with axially extending radius surfaces at both contact points A and B. The groove 25 is also formed slightly deeper than necessary to accommodate the seal segment 20 so that expansion of the material of the segment 20 caused by temperature variations within the turbine engine can be accommodated without stressing the seal segment. For that reason there is also additional space at 38 at the top of upper region 21 for accommodating thermal growth.

A significant feature of the present invention is the design such that a center of gravity CG of segment 20 exists in the segment portion 21. During engine operation, the seal segment 20 is rotated about an engine axis at relatively high speed. The centrifugal loading exerted upon the seal segment 20 drives the segment radially outwards until finger 22 contacts the inner surface of tang 15A at R. At this point, centrifugal loading causes point R to act as a pivot creating a moment M which tends to twist or rotate the seal segment in the direction indicated by arrow M. The moment M increases the sealing force at point A and at point B by attempting to rotate or twist the seal against the contact surfaces at those points.

FIG. 4 illustrates in a partial cutaway view the circumferential spacing and location of the tangs 15A which interface with the fingers 22 for supporting the seal 20 against the root portion of each of the rotor blades. FIG. 4 further shows the substantially complete coverage of all of the gaps existing between the blade roots and the rotor disk and the covering of a substantial portion of the gap 19 between each of the adjacent blade platforms.

Figure 5:
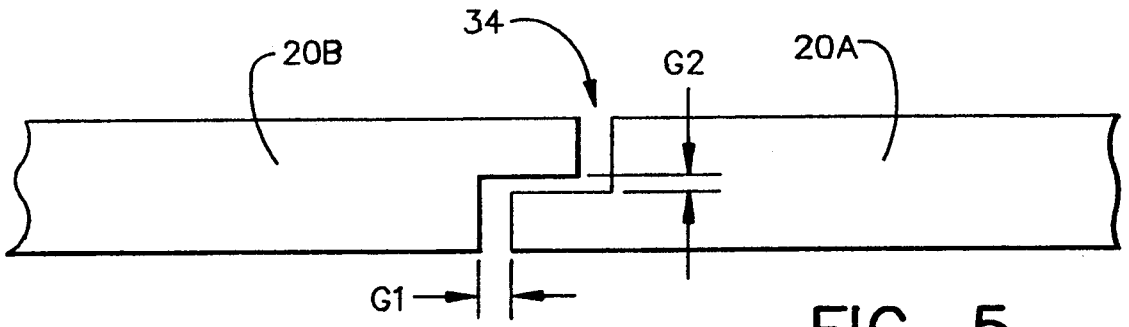
FIG. 5 is a schematic illustration of one form of overlapping seal connection.

As noted above, the seal segments are installed by positioning the lower region 30 within the groove 25 and then rotating the seal segments 20 towards the rotor disk such that the fingers 22 are interdigitated with the radially depending tangs 15A. The seal segment is then rotated or clocked a distance sufficient to position the fingers 22 behind the tangs 15A thereby restraining the seal segments 20 against the blade root portions. As each of the seal segments are rotated into this position, the ends of the seal segments are brought into contact with each other so as to minimize air flow between adjacent seal segments. In FIG. 5, there is shown one form of overlapping joint between adjacent seal segments 20A and 20B. The joint 34 has a circumferential gap G1 and an axial gap G2. These gaps are sufficiently small that minimal leakage occurs between adjacent seal segments. However, some gap is necessary in order to accommodate thermal growth and expansion of the seal segments with engine temperature changes. The lines at 34 in FIG. 4 indicate an overlapping joint of the type shown in FIG. 5.

While the invention has been described in what has presently considered to be a preferred embodiment, various modifications and improvements may become apparent to those skilled in the art. It is intended therefore that the invention not be limited to the specific illustrative embodiment but be interpreted within the full spirit and scope of the appended claims.

What is claimed is:

1. A seal assembly for minimizing air leakage about a blade root region of rotor blades in a compressor stage of a gas turbine engine, the blade root region including a blade platform and a blade root, the blade root being axially inserted into slots in a rotor disk, the seal assembly comprising:

a plurality of arcuately shaped plate-like members forming an annular ring, said ring having a radially outer edge held in sealing engagement with a surface of the platform of the rotor blade and a radially inner edge held in sealing engagement with a surface on the rotor disk, the seal assembly overlaying the blade roots and corresponding slots for minimizing air flow therethrough;

a plurality of disk posts each extending radially outward between adjacent ones of the rotor slots of the rotor disk, each disk post having a tang extending therefrom for capturing a mating finger-like member on said seal assembly for holding said seal assembly in engagement with the blade root region;

a circumferential groove defined between an edge of the rotor disk and a circumferential flange formed thereon, said radially inner edge being defined on a radially inner portion of said seal assembly, said inner portion being at least partially disposed in said groove when said seal assembly is in an assembled position, said inner edge contacting an axially forward surface of said flange for establishing a seal therebetween;

each of said tangs depending radially inward and defining an annular slot between the tangs and an adjacent surface of the disk posts, each of the finger-like members extending radially outward from each said seal assembly and into said slot for retaining said seal assembly in an assembled position; and each plate-like member of said seal assembly having a center of gravity axially displaced from said finger-like members, rotation of the rotor disk being effective to exert a centrifugal force to drive said seal assembly radially outward wherein said finger-like members engage said tangs for creating a pivot point for rotation of said seal assembly, said displaced center of gravity creating a moment of rotation of each plate-like member of said seal assembly about a tangent line to said finger-like members in a direction to enhance said sealing engagement with each of said platform surface and said circumferential flange.

2. The seal assembly of claim 1 wherein said finger-like members are circumferentially spaced about said seal assembly, each of said finger-like members being narrower than the blade root for enabling assembly of the seal assembly to the rotor disk.

3. The seal assembly of claim 2 and including an overlapping joint at each end of each plate-like member for minimizing air leakage between said members.

4. The seal assembly of claim 1 wherein each of said rotor blades includes an axially aft extending arcuate extension for contacting said seal assembly.

* * * * *